United States Patent [19]

Garutso

[11] Patent Number: 4,632,118

[45] Date of Patent: Dec. 30, 1986

[54] BRASSIERE WITH STRESS BREAKER INSERTS

[76] Inventor: Sonia Garutso, 512 S. Carondelet - No. 217, Los Angeles, Calif. 90057

[21] Appl. No.: 842,796

[22] Filed: Mar. 24, 1986

[51] Int. Cl.[4] ..... A41C 3/10

[52] U.S. Cl. ..... 128/477

[58] Field of Search ..... 128/478, 479–481

[56] References Cited

U.S. PATENT DOCUMENTS 2,915,067 12/1959 Bracht ..... 128/477

3,421,515 1/1969 Schaefer ..... 128/477

*Primary Examiner*—Doris L. Troutman

*Attorney, Agent, or Firm*—Georges A. Maxwell

[57] ABSTRACT

The combination of a brassiere with a pair of laterally spaced, forwardly projecting, rearwardly opening, concavo, convex breast receiving cups of flexible fabric and force receiving and distributing reinforcing inserts removably engaged within the lower quadrant portions of said cups and below a wearer's breasts engaged therein. The inserts include elongate, laterally extending, flexible fabric panels with upper forward and lower rear edges, force receiving and distributing bases at and along said lower rear edges and pluralities of laterally spaced, elongated, flexible, resilient reinforcing stays carried by the panels with upper ends adjacent said upper forward edges of the panels and lower rear ends at the lower rear edges of the panels and in force transmitting relationship with said bases.

10 Claims, 12 Drawing Figures

BRASSIERE WITH STRESS BREAKER INSERTS

This invention has to do with the art of brassieres and is particularly concerned with a supplemental breast support insert for brassieres.

BACKGROUND OF THE INVENTION

It has been recognized that the supporting of women's breasts to counter the forces of gravity and other externally applied forces which tend to draw and stretch the tissues of breasts and which subject breasts to undesirable impacting and reacting forces is most desirable and beneficial. Controlled support and contouring of women's breasts is also considered desirable for aesthetic purposes.

As a result of the above, the art of brassieres has become a highly developed and crowded art in which many different, special and unique brassiere stuctures have been provided to afford various special supporting and contouring characteristics and features.

As the art of brassieres has developed, a common and basic brassiere structure has developed, which basic structure is characterized by a lower body embracing girdle-like band of soft, flexible fabric which occurs about a wearer's torso adjacent the underside of the wearer's breasts, a pair of laterally spaced forwardly projecting rearwardly opening concavo convex breast receiving cups of soft, flexible fabric fixed to and projecting forwardly from the front portion of the band and in which the wearer's breasts are received and shoulder straps fixed to the tops of the cups and extending upwardly, rearwardly and downwardly over the wearer's shoulders and joined with the rear of the band.

The size, shape and details of construction of the several parts and/or portions of the above noted basic brassiere structure varies greatly.

The overwhelming majority of brassiere structure which can be distinguished from the above noted basic brassiere structure are rather few in number and are often little more than variations thereof.

The function of the above noted basic or common brassiere structure to contain and support a wearer's breasts is apparent and well-known to all of those who are familiar with the art of brassieres.

While the size and shape of women's torsos and shoulders and the size, shape and positioning of their breasts varies substantially infinitely, commercially available brassieres are produced in a relatively small number of different sizes and shapes, each of which in fact properly fits an extremely small number of women. However, the numbers of different sizes and shapes of brassieres that are commercially available is sufficient so that the great majority of women can obtain brassieres which fit them reasonably well, though such fit is most often a compromise.

Most women's breasts are somewhat pendulous and drop or hang to establish a lower rear fold or crease below the lower rear portions of their breasts and torsos. The desired function of a brassiere is to hold its wearer's breasts up and forward and thereby eliminate or reduce the lower rear folds of their breasts and to counter and/or reduce those forces and stresses which cause such folds.

A principal shortcoming of most common brassieres resides in the tendency for the front portions of the bands of the brassieres to creep upwardly into the folds behind the lower pendulous portions of the wearer's breasts and for the lower portions of the cups of the brassieres to be drawn up into said folds thereby. When the foregoing takes place, the displaced portions of the brassieres are not merely discomforting to the wearers but tend to concentrate forces directly onto and along the fold lines between the wearer's breasts and torsos and tend to cut and/or seriously adversely affect and weaken the tissue worked upon. When the above takes place, such brassieres fail to perform the important function of reducing certain adverse stresses within the wearer's breasts and in fact tend to increase those stresses.

In the prior art, the capability and effectiveness for a brassiere to support and hold the lower rear pendulous portion of a wearer's breasts up and forward and thereby eliminate or reduce the lower rear folds established thereby and to counter adverse effects thereof, brassieres have been constructed with various reinforcing wires and stays to stiffen and reinforce the bands of the brassieres so that they are less likely to work up into the noted lower folds of the breasts.

In other brassiere constructions provided by the prior art, the bands are established with upper forward portions which normally extend upwardly into and across said folds and overlie the lower rear portions of the cups to define pockets in which the pendulous portions of wearer's breasts are supported. In shuch a brassiere, the weight of the portions of the wearer's breasts in the pockets tend to hold the upper portion of the band down and thereby prevents it from cutting into the wearer.

In yet other forms of brassieres provided by the prior art, a series of laterally spaced elongate, forwardly projecting flexible stays are engaged in sleeves formed in the lower quadrant portion of the brassieres cups. Those stays have lower ends which are fixed to and stop against the bands of the brassieres and project forwardly and upwardly from the bands in splayed relationship to each other, throughout the lower rear portions of the wearer's breasts. The noted stays hold up and support the lower rear pendulous portions of the wearer's breasts and direct the forces of the weight of the breasts downwardly and rearwardly onto the bands, holding the bands down in their intended position. The stays also serve to prevent the cups from becoming distorted and out of desired set form and position.

This last noted form of brassieres has proven to be most desirable, comfortable and effective but due to the extra work and high cost of adding such stays to brassieres, such brassieres have proven to be excessively costly and have met with limited commercial success. Still further, to be most effective, the stays in such brassieres must be adjusted and set for each wearer which requires that such brassieres be custom made if best results are to be attained thereby.

OBJECTS AND FEATURES OF MY INVENTION

It is an object of my invention to provide inserts to be placed in the cups of brassieres which inserts serve to receive the vertical weight forces of the wearer's breasts and to transmit those forces rearwardly and downwardly onto the bands of the brassieres, thereby preventing adverse distortion and placement of the cups and of the bands of the brassieres and effectively yieldingly holding the lower pendulous portions of the wearer's breasts up and forwardly in the cups and relative to the bands.

It is an object and feature of my invention to provide inserts for the purpose set forth above which are such that they can be easily engaged in the cups of most commercially available brassieres and are such that they can be moved and set within the cups of related brassieres to adjust and set the cups in proper fit with the breasts of the wearers of the brassieres.

It is an object and feature of my invention to provide brassiere cup inserts of the general character referred to above including elongate substantially laterally extending flexible fabric panels with substantially concave lower rear edges which occur adjacent the bands of their related brassieres, substantially convex upper forward edges which occur in the lower forward quadrant portions of their related brassiere cups, substantially convex lower brassiere cup engaging surfaces, substantially concave breast engaging top surfaces and laterally spaced forwardly and laterally outwardly splayed elongate flexible stays carried by the panels and extending between said lower rear and upper forward edges of the panels.

It is an object and feature of my invention to provide brassiere cup inserts of the general character referred to above that are easy and economical to make and to sell and which are such that they can be removably related to the overwhelming majority of different makes and models of commercially available brassieres to noticeably enhance the functions of the brassieres and to enhance the appearance of the users thereof.

The foregoing and other objects and features of my invention will be fully understood from the following detailed description of typical preferred forms and embodiments of my invention, throughout which description reference is made to the accompanying drawings.

DESCRIPTION OF THE DRAWINGS

FIG. 7 is a front view of another form of insert embodying my invention;

DETAILED DESCRIPTION OF THE INVENTION

Figure 1:
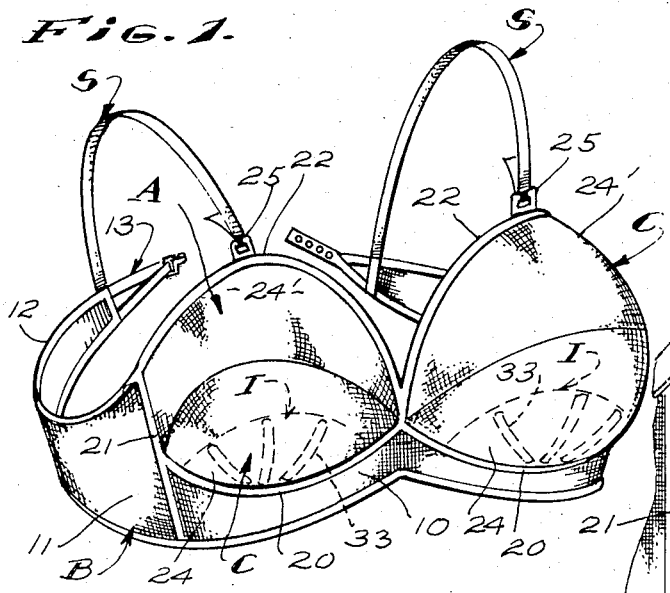
FIG. 1 is a perspective view of a brassiere embodying my invention.

In FIG. 1 of the drawings, I have shown a typical brassiere structure A. The brassiere structure A is characterized by a body or torso engaging band B, a pair of laterally spaced forwardly projecting breast receiving cups C and shoulder straps S.

The band B of the brassiere structure A is fabricated of soft, flexible fabric and has front, side and rear portions 10, and 12. The band B is suitably formed and shaped to extend about the upper torso of a wearer of the brassiere in an effective and comfortable manner. The rear portion of the band is cut, divided or split and is provided with hook and eye type adjustable fastening means 13.

The pair of laterally spaced forward breast receiving cups C of the brassiere structure A are substantially concavo convex, forwardly projecting and rearwardly opening structures fabricated of soft, flexible fabric. There is a left cup and a right cup, each having a horizontally extending lower edge 20 fixed to an adjacent portion of the front portion 10 of the band B, a substantially vertical outer edge portion 21 fixed to an adjacent edge portion of its related side portion 11 of the band B and an upper convex top edge 22 with upper, outer and lower inner ends extending upwardly and laterally inwardly from the upper end of its related edge 21 and thence laterally inwardly and downwardly to the inner end of the lower edge 20 of the cup.

In the case illustrated, the inner ends of the top edges 22 of the left and right cups C converge with each other at the center of the front portion 10 of the band B, as clearly shown in FIG. 1 of the drawings.

The cups C have lower forward quadrant portions with normally substantially rearwardly and upwardly disposed concave lower inside surfaces 23 and oppositely disposed convex outer surfaces 24 and have upper forward quadrant portions with normally substantially rearwardly and downwardly disposed concave inside surfaces 23' and oppositely disposed convex outer surfaces 24'.

In the brassiere construction illustrated, the above noted upper and lower quadrant portions of the cups C are established by suitably formed fabric pieces stitched together.

The shoulder straps S include right and left hand shoulder straps established of ribbon-like fabric strap material with front end portions suitably adjustably fastened to the central portions of the top edges 22 of their related cups C as shown at 25 and have rear ends suitably fastened to related right and left portions of the split or cut back portion 12 of the band B. The straps S extend upwardly and rearwardly from the cups and thence rearwardly and downwardly to the band, substantially as shown.

The fastening means 13 is shown as established of flexible ribbon-like straps fixed to the right and left hand cut ends of the rear portion 12 of the band B and by a plurality of longitudinally spaced eyes on one of those straps and a hook on the other of those straps and selectively releasably engageable in the said eyes.

The brassiere structure A illustrated and described above does not and is not intended to show any special or particular form and construction of brassiere but is only intended to illustrate a typical brassiere structure suitable for use in carrying out my invention.

The only structural details and/or features of the brassiere structure A that are of particular concern and which affect my invention reside in the form and relationship of the forward portion 10 of the band B and the forward lower quadrant portions of the cups C. The form and relationship of said forward portion 10 of the band B and the cups C are essentially standard in most brassiere structures, so far as my invention is concerned.

In practice and/or in use, the band B of the brassiere A is engaged about the upper torso of the wearer with the front portion 10 of the band extending horizontally, transversely across the front of the wearer's torso immediately below the wearer's breasts. The wearer's breasts are engaged in, supported by and substantially conform to the interior configuration of the cups C. The straps S extend over the wearer's shoulders to hold the back portion of the band up, draw and hold the tops of the cups to hold the wearer's breasts up and forward and to thereby support a desired portion of the weight of the wearer's breasts.

It will be apparent that the wearer's breasts, being substantially plastic and fluid in nature, tend to drop in and their weight is directed downwardly in the lower forward quadrant portions of the cups C. The lower forward portions of the breasts tend to turn and drop down to a pendulous position and establish a lower rear fold. As the breasts drop and fold in the manner set forth above, the soft, flexible cups flatten and distort to conform to the breasts. In doing so, the forward portion of the band B and adjacent lower rear edges 20 of the cups C are substantially free to move upwardly into the lower rear fold behind and defined by the lower pendulous portions of the breasts. When the foregoing occurs, while the cups continue to contain the breasts, they no longer provide the vertical lift and support for the breasts which the brassiere is intended to provide.

In furtherance of my invention, I provide inserts I engageable within the lower quadrant portions of the cups C of the brassiere structure A. The inserts I serve to yieldingly support and hold the lower portions of the wearer's breasts up and therefore forwardly within the cups C and to yieldingly prevent the lower portions of the breasts from dropping and turning downwardly and rearwardly to fully pendulous and unsupported condition or positions.

In attaining the above end, the inserts I are such that they receive and transmit downwardly directed weight forces of the wearer's breasts rearwardly and downwardly to the lower edges 22 of their related cups C and to the front portion 10 of the band B and thence to the wearer's torso. By yieldingly and resiliently supporting the lower portion of the wearer's breasts up in the manner set forth above, the band B and bottom edge portions of the cups C are prevented from moving upwardly into the lower rear folds of the wearer's breasts and the cups C are prevented from being drawn down and distorted or flattened to an extent that they can no longe offer desired and intended vertical support for the wearer's breasts and/or shape and hold the wearer's breasts in desired and intended form.

The inserts I include elongate laterally extending, normally substantially flat panels 30 established of soft, flexible fabric and which conform to the surfaces 23 of their related cups C. The panels 30 have normally substantially straight lower rear edges 31 which curve in a concave fashion to most effectively conform to the lateral curvature of the related portions of the wearer's breasts and torso when set in the cups C. The inserts have convexly curved upper forward edges 32 substantially as shown. The panels 30 are provided with a plurality of laterally spaced elongate forwardly and upwardly extending flexible resilient stays 33 with lower rear ends in set stopped relationship with their related edges 31 and upper forward ends terminating at or adjacent to their related edges 32. The stays 33 are preferably arranged in splayed relationship to each other with their central longitudinal axes converging rearwardly and downwardly and diverging forwardly and upwardly so that substantial uniform support is afforded by the stays about the normally substantially convexly curved lower surfaces of the wearer's breasts.

In practice, the stays 33 are flat, resilient plastic strips and are slidably engaged in and retained by sleeves 34 established at the lower forward surfaces 35 of the panels by fabric ribbon stitched to the panels. The upper end of the sleeves 34 are closed by and the edges 32 are finished by suitable stitched rolled seams 36. The lower ends of the sleeves are closed by and the lower rear edge 31 of the inserts are finished with base strips 37 which establish effective stops for the lower rear ends of the stays 33 and effective force or load receiving and distributing means at and along the edges 31. The base strips 37 are such that forces transmitted by the stays at the edges 31 are not concentrated to any notable extent at points spaced longitudinally of the base strips, but rather, are distributed substantially uniformly throughout the longitudinal extent of strips.

Figure 2:
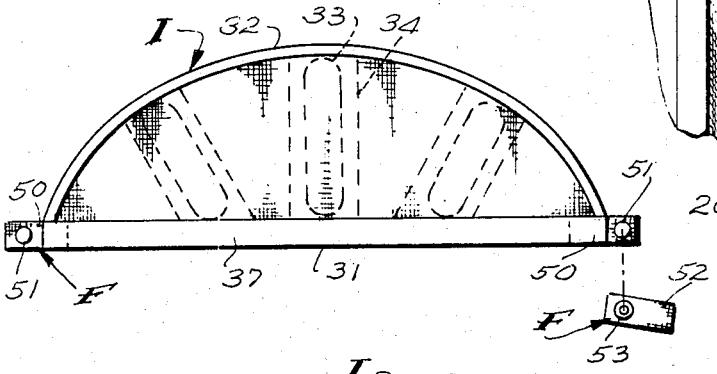
FIG. 2 is a front view of an insert that I provide.
Figure 5:
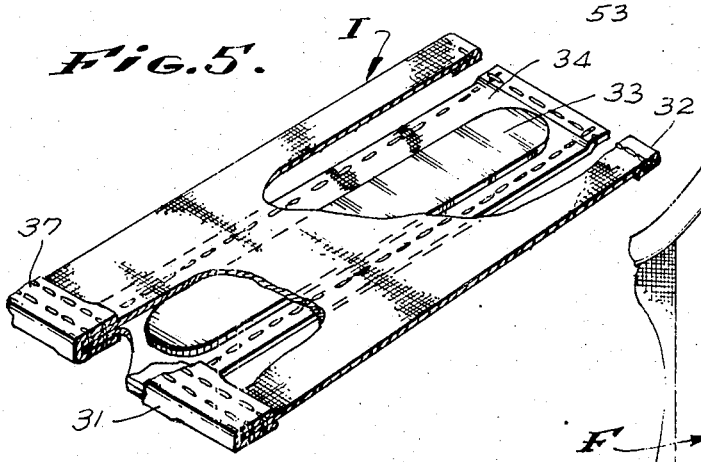
FIG. 5 is an isometric view of a portion of the insert shown in FIGS. 2 and 3 to better illustrate details of the construction.
Figure 3:
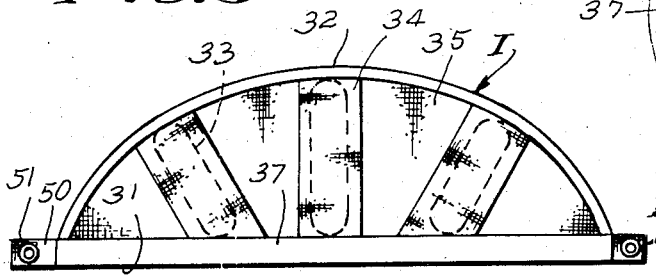
FIG. 3 is a rear view of the insert.
Figure 2:
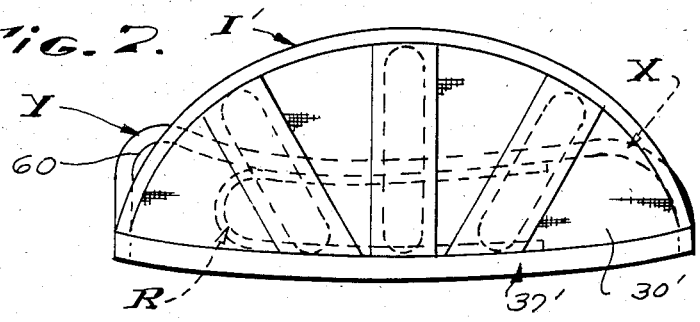

In practice and as shown in FIGS. 2 and 5 of the drawings, the base strap 37 of such insert can be established by a suitable strip of thick, soft, padded, ribbon-like fabric folded and stitched about the lower rear edge portion of the panel.

The seams 36 and base straps 37 finish and in effect define the noted edges 31 and 32 of the panels 30. Accordingly, in the following, reference to the edges 32 includes the seams 36 which define them and reference to the edges 31 refers to the rear edge of the panel 31 and/or the rear edge or surface of the base strap 37, whichever the case might be for clear explanation and understanding of my invention.

In FIG. 1 of the drawings, the inserts I are shown in dotted lines within the cups C of the brassiere A.

Figure 4:
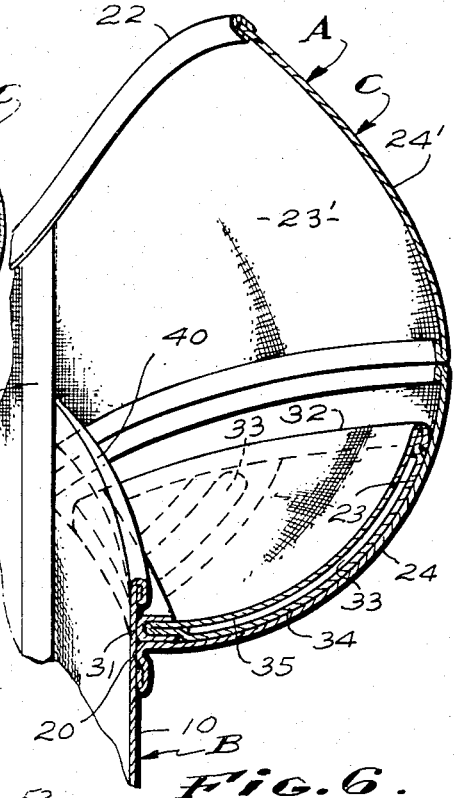
FIG. 4 is a cross-sectional view through one cup of the brassiere shown in FIG. 1 showing the insert engaged therein.

In FIG. 4 of the drawings, an insert I is shown engaged in a related cup C of the brassiere structure. The lower rear edge 20 of the cup C is shown stitched and fixed to the front surface of the forward portion 10 of the band B, below the upper edge 40 of the band which is finished and defined by a roll seam. The upper portion of the forward portion 10 of the band cooperates with the cup C to define a shallow upwardly opening pocket in and across the lower portion of the cup and in which the lower pendulant portion of the wearer's breast is to be set and supported.

In FIG. 4 of the drawings, it will be apparent that the noted pocket effectively receives, supports and retains the insert I. It will also be apparent that the base strap 37 and/or lower edge 31 of the insert I substantially conforms to the lower rear edge 20 of the cup C and stops against and is supported by the adjacent portion of the band B.

Figure 6:
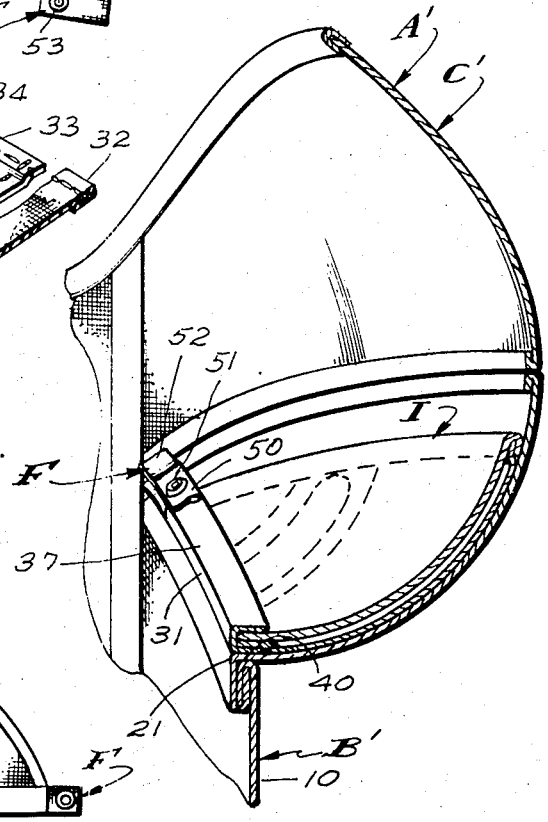
FIG. 6 is a view similar o FIG. 4 showing my insert related to another form of brassiere.

In FIG. 6 of the drawings, the insert I is shown engaged in the cup C' of another common form of brassiere structure A' wherein the lower rear edge 21' of the cup C' is joined with and fixed to the top edge 40' of the band B' by a suitable seam structure and wherein no pocket or the like for retaining the insert I is presented. In this combination of brassiere and insert, the insert I is engaged and supported in the lower quadrant portion of the cup C' with the base strap 37 or lower rear edge 31 thereof conformed with and extending longitudinally of the edge 21' of the cup. In this embodiment of my invention, the edge 31 or strap 37 is supported from below by the cup and/or band and is engaged, shaped and supported at its rear by the torso of the wearer.

In furtherance of my invention, the opposite ends of each insert I are provided with fastening means F to releasably fasten the insert in set position in a related brassiere cup. In the case illustrated, the fastening means includes fabric tabs 50 with snap fastener parts 51 fixed to the opposite ends of and projecting longitudinally outwardly from the base strap 37 and fabric tabs 52 with mating snap fastener parts 53 which are or can be suitably fastened and fixed (as by tack stitches) in their related brassiere cups.

In the form of the invention shown in FIG. 4 of the drawings, utilization of the fastening means F might not be required. In the form of the invention shown in FIG. 6 of the drawings, the fastening means F is preferably employed and effectively releasably fastens or secures the insert I in the cup C', holding the base strap 37 and/or lower rear edge 31 down and rearward along the edge 20' of the cup. Thus, the insert is prevented from shifting forwardly and upwardly or laterally in the cup, when in use.

In practice, the lateral extent of the inserts I are preferably less than the lateral extent of the lower edges of the brassiere cups with which the inserts are to be related so that the lateral placement of the inserts in the cups can be adjusted to those positions within the cups where they afford the most effective and comfortable support for the wearers of the brassieres. Such lateral adjustment of the inserts is important and most desirable since it enables the users of the insert equipped brassiere to move and adjust the insert laterally within the brassiere cups to position where maximum support is provided. It also allows the users to move and adjust the inserts laterally to compensate for dissimilarities of their breasts and to attain a more balanced and attractive appearance.

In the form of my invention now under consideration, but for the stays 33 which are resilient and flexible and the support straps 37 which, while sufficiently stiff to receive and distribute forces applied thereto by the stays, the inserts are soft, pliable and highly flexible units. The principal purpose and function of the inserts is to suitably position and retain the stays 33 thereof in related brassiere cups and to most effectively spread and distribute those forces which are applied to and conducted downwardly and rearwardly by the stays onto and throughout the brassiere structure and the wearer's torso in a most effective and comfortable manner.

Figure 9:
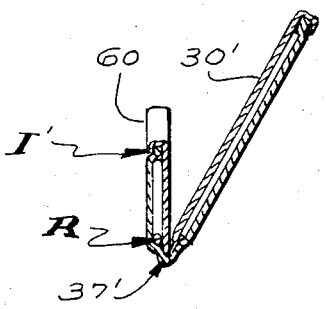
FIG. 9 is a cross-sectional view taken as indicated by line 9—9 on FIG. 8.
Figure 8:
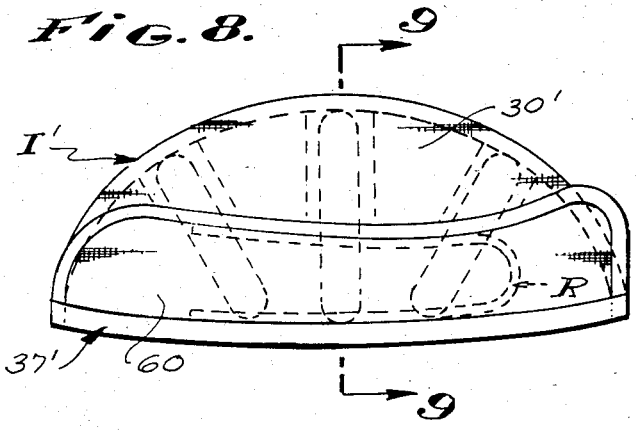
FIG. 8 is a rear view of the insert shown in FIG. 7.

In FIGS. 7 through 9 of the drawings, I have illustrated another form of insert I' embodying my invention. In this second form of insert, the elongate, laterally extending base strap 37' includes or is formed to establish a flat, vertical, longitudinal extending upwardly projecting retaining flange 50 which is a rather stiff, though flexible, laminated fabric structure. The retaining flange 50 occurs rearward of the lower pendulant portion of the wearer's breasts and cooperates with the panel 30' of the insert I' to define an elongate, laterally extending, upwardly opening pocket in which a portion of the pendulant portion of the wearer's breast is contained. In this embodiment of my invention, the weight force of the portion of the wearer's breast within the noted pocket and acting upon the insert urges the flange 50 rearwardly into conformity with the opposing adjacent portion of the wearer's torso.

In practice and as shown in dotted lines, the flange 50 is a laminate structure and can be provided with and carry a resilient support means R to normally yieldingly maintain the flange vertically extended and to prevent collapsing and/or folding of that flange. As shown in dotted lines, the means R can be a U-shaped length of resilient, monofilament plastic positioned within the flange structure and having substantially horizontal top and bottom legs set within seams at the top and bottom edges of the flange structure.

Figure 10:
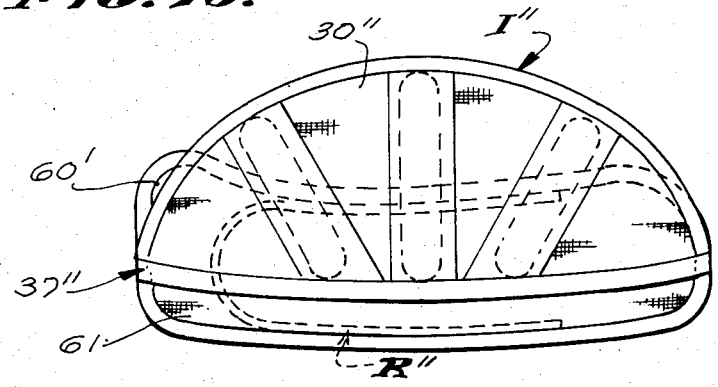
FIGS. 10 and 11 are front and rear views of yet another form of inset.
Figure 12:
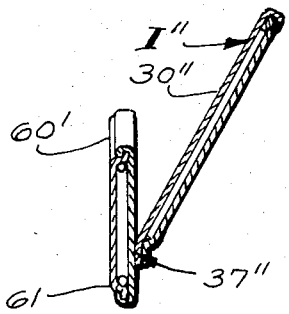
FIG. 12 is a sectional view taken as indicated by line 12—12 on FIG. 11.
Figure 11:
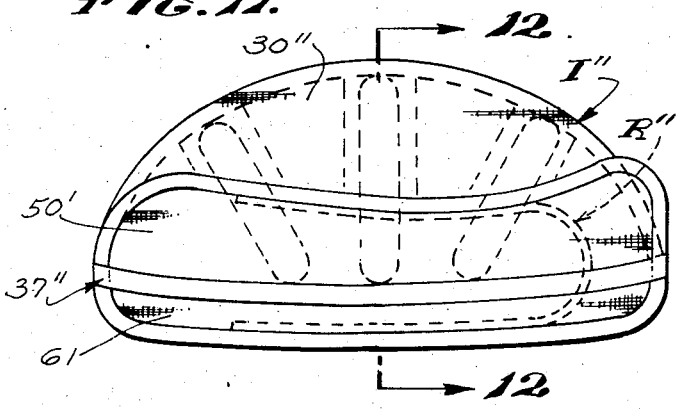

In FIGS. 10 through 12 of the drawings, I have illustrated yet another form of insert I" embodying my invention. In the insert I", the base strap 37", in addition to having an upper retaining flange 50' similar to the flange 50 in the last noted form of insert, has a lower depending flange or flange portion 53 depending from the lower rear edge of the insert panel 30" and which serves to provide added vertical stiffening of the base strap 37". This form of insert is particularly intended and suitable for use in combination with that form of brassiere shown in FIG. 6 of the drawings and serves to receive the downwardly and rearwardly directed forces at the lower rear edge of the brassiere with which it is related and to spread and distribute those forces onto the torso of the wearer in a most comfortable manner.

This last form of my invention is also particularly suitable for use in that form of brassiere (not shown) wherein the band of the brassiere is a sectional structure without a front portion and wherein the cups of the brassiere are fixed together at the center of the brassiere and are fixed to and extend between the lateral spaced side portions of the band.

In this last noted form of insert, a support means R", similar to the support means R in the previously noted form of my insert, can be provided if desired.

In the first forms of my invention shown in FIGS. 1 through 6 of the drawings, the pairs of inserts I are similar in size and shape and are interchangeably engageable in the right and left cups of related brassieres.

In the forms of my invention shown in FIGS. 7 through 12 of the drawings, the flanges 50 and 50' are not symmetrical, but are characterized by concave laterally extending upper edges with downwardly and laterally inwardly radiused lower inner ends X and upwardly and laterally outwardly and thence downwardly turned upper outer ends Y. Thus, each pair of inserts I' or I" must include a left and right insert for the left and right cups of the brassieres with which they are to be related.

In FIGS. 7 through 12 of the drawings, right inserts I' and I" are illustrated. It will be apparent and it is to be understood that the right inserts I' and I" illustrated are one of pairs of right and left inserts and that the left insert (not shown) are characterized and distinguished from the right inserts by their inclusion of flanges 50 and 50' which are mirror opposites of the flanges 50 and 50' of the right inserts.

It is to be noted that the flanges 50 and 50' for the inserts I' and I" might be made similar and that the noted differences between left and right inserts might be eliminated, without departing from my invention.

In practice, the shape of the panels, the number and arrangement of the reinforcing stays and the shapes of the flanges of my inserts are subject to wide variation without in any way departing from the broader aspects and spirit of my invention. I have determined that by changing the shapes and relative sizes of the several components, parts and portions of my inserts, sets of inserts specifically and better suited for engagement in different sizes, models and makes of brassieres and for providing better support and contouring of different sizes and shapes of breasts can be easily and effectively provided.

Further, in practice, the details of construction of my inserts, while limited by what can be called good and accepted standards and practices, is subject to wide variation. Changes in the details of construction of my insert are likely to be dictated by the use of different fabric and materials by the use of different equipment and procedures in the manufacture of the inserts and by notable changes made in the size, shape and relative proportioning of parts and portions of the inserts.

In accordance with the foregoing, the size, shape and construction of the inserts I, I' and I'', shown in the drawings, are not intended and should not be looked upon as limiting the size, shape and/or construction of the inserts, but rather, are intended and should be looked upon as being merely indicative of the forms and/or constructions in which my inserts might be advantageously provided.

In the forns of my invention shown in FIGS. 7 through 12 of the drawings, for purposes of convenience, I have elected not to show the fastening means F shown in the first form of my insert structure applied or related thereto. It is to be understood that in practice, the second and third form of my insert would be provided with such fastening means in the event that the purchasers and users of such inserts find that such fastening means are required.

Having described only typical preferred forms and embodiments of my invention, I do not wish to be limited to the specific details herein set forth but wish to reserve to myself any modifications and/or variations that might appear to those skilled in the art and which fall within the scope of the following claims.

Having described my invention I claim:

1. In combination, a brassiere having a pair of laterally spaced, forwardly projecting, rearwardly opening concavo convex breast receiving cups of soft, flexible fabric with substantially laterally extending top and bottom edges with lateral inner and outer ends, a torso engaging band with opposite side portions joined with and extending laterally and rearwardly from the outer ends of the cups to a laterally extending rear portion of said band, brassiere cup inserts removably engaged within lower quadrant portions of said cups, each insert includes an elongate laterally extending flexible fabric panel with substantially laterally extending upper forward and lower rear edges, an elongate, flexible support base on and extending longitudinally of said lower rear edge and substantially conformed with and extending longitudinally of said bottom edge of its related cup, a plurality of elongate, flexible resilient reinforcing stays carried by the panel in lateral spaced relationship from each other and having lower rear ends stopped against the base and upper forward ends terminating adjacent said upper forward edge of the panel, the stay reinforced inserts conform to the adjacent portions of the brassiere cups and a wearer's breasts within the cups to direct the weight force of the wearer's breasts downwardly and rearwardly to the bottom edges of the cups and yieldingly urge and hold the wearer's breasts and the lower quadrant portions of the cups forwardly and upwardly.

2. The combination set forth in claim 1 which further includes releasable fastening means releasably securing the opposite ends of the inserts in the cups with said bases of the inserts adjacent said bottom edges of the cups.

3. The combination set forth in claim 2 wherein the band has a front portion overlying the lower portions of the rearwardly opening cups and cooperates with said cups to define upwardly opening pockets within the lower rear quadrants of the cups, said inserts are positioned in said pockets with their bases at the lines of joinder between the band and the bottom edges of the cups.

4. The combination set forth in claim 1 wherein the band has a front portion overlying the lower portions of the rearwardly opening cups and cooperates with said cups to define upwardly opening pockets within the lower rear quadrants of the cups, said inserts are positioned in said pockets with their bases at the lines of joinder between the band and the bottom edges of the cups.

5. The combination set forth in claim 1 wherein said elongate flexible bases of the inserts have longitudinally extending upwardly projecting flexible fabric flanges cooperating with the lower rear portions of the panels to define upwardly opening breast receiving pockets.

6. The combination set forth in claim 1 wherein said elongate flexible bases of the inserts have longitudinally extending upwardly projecting flexible fabric flanges cooperating with the lower rear portions of the panels to define upwardly opening breast receiving pockets, and releasable fastening means releasably securing the opposite ends of the inserts in the cups with said bases adjacent to said bottom edges of the cups.

7. The combination set forth in claim 1 wherein said elongate flexible fabric bases of the inserts have longitudinally extending upwardly projecting flexible fabric flanges cooperating with the lower rear portions of the panels to define upwardly opening breast receiving pockets and longitudinally extending downwardly projecting flexible fabric reinforcing torso engaging flanges.

8. The combination set forth in claim 1 wherein said elongate flexible fabric bases of the inserts have longitudinally extending upwardly projecting flexible fabric flanges cooperating with the lower rear portions of the panels to define upwardly opening breast receiving pockets and longitudinally extending downwardly projecting flexible fabric reinforcing torso engaging flanges, and releasable fastening means releasably securing the opposite ends of the inserts in the cups with said bases adjacent said bottom edges of the cups.

9. The combination set forth in claim 1 wherein said elongate flexible fabric bases of the inserts have longitudinally extending upwardly projecting flexible fabric flanges cooperating with the lower rear portions of the panels to define upwardly opening breast receiving pockets and longitudinally extending downwardly projecting flexible fabric reinforcing torso engaging flanges, and resilient reinforcing means within the bases of the inserts between upper and lower edges of the flanges thereof normally yieldingly urging said upper and lower edges of the flanges vertically apart and the flanges taut therebetween.

10. The combination set forth in claim 1 wherein said elongate flexible fabric bases of the inserts have longitudinally extending upwardly projecting flexible fabric flanges cooperating with the lower rear portions of the panels to define upwardly opening breast receiving pockets and longitudinally extending downwardly projecting flexible fabric reinforcing torso engaging flanges, and resilient reinforcing means within the bases of the inserts between upper and lower edges of the flanges thereof normally yieldingly urging said upper and lower edges of the flanges vertically apart and the flanges taut therebetween, and releasable fastening means releasably securing the opposite ends of the inserts in the cups with said bases of the inserts adjacent the bottom edges of the cups.

* * * * *